US009089763B2

(12) United States Patent
Brown et al.

(10) Patent No.: US 9,089,763 B2
(45) Date of Patent: Jul. 28, 2015

(54) SKATE BOOT FORCE ABSORBING APPLIANCE

(71) Applicants: Christopher A. Brown, Worcester, MA (US); Karin E. Greene, Middletown, CT (US); Devon L. Rehm, Kokomo, IN (US)

(72) Inventors: Christopher A. Brown, Worcester, MA (US); Karin E. Greene, Middletown, CT (US); Devon L. Rehm, Kokomo, IN (US)

(73) Assignee: Worcester Polytechnic Institute, Worcester, MA (US)

( * ) Notice: Subject to any disclaimer, the term of this patent is extended or adjusted under 35 U.S.C. 154(b) by 0 days.

(21) Appl. No.: 14/242,142

(22) Filed: Apr. 1, 2014

(65) Prior Publication Data

US 2014/0291946 A1 Oct. 2, 2014

Related U.S. Application Data

(60) Provisional application No. 61/807,066, filed on Apr. 1, 2013.

(51) Int. Cl.
*A63C 1/24* (2006.01)

(52) U.S. Cl.
CPC ..... *A63C 1/24* (2013.01); *A63C 2203/20* (2013.01)

(58) Field of Classification Search
USPC ..... 280/11.14, 7.13, 7.15, 841, 11.115, 280/11.19, 11.221, 11.223, 11.231
See application file for complete search history.

(56) References Cited

U.S. PATENT DOCUMENTS

| | | | | |
|---|---|---|---|---|
| 1,597,792 | A | 8/1926 | Hoff | |
| 3,339,936 | A * | 9/1967 | Hamlin | 280/11.207 |
| 4,351,538 | A | 9/1982 | Berta | |
| 5,127,672 | A * | 7/1992 | Horibata | 280/842 |
| 5,503,413 | A | 4/1996 | Belogour | |
| 5,544,431 | A | 8/1996 | Dixon | |
| 5,823,543 | A | 10/1998 | Burns | |
| 6,135,463 | A * | 10/2000 | Wrike | 280/11.221 |
| 6,336,643 | B1 | 1/2002 | Wu | |
| 6,568,102 | B1 | 5/2003 | Healy | |
| 7,531,068 | B2 | 5/2009 | Park | |
| 7,830,801 | B2 | 11/2010 | Kwan | |
| 2008/0067763 | A1 * | 3/2008 | Zampieri | 280/11.224 |

OTHER PUBLICATIONS

Manser, Ann. "New Skate Designed to Reduce Injuries." University of Delaware Daily. N.P., Apr. 29, 2004. Web. Jun. 2012. <http://www.jacksonskates.com/html2/hinged-skate.htm>.

Waldman, Peter. "Figure Skaters Blame Boot Design for Injury Plague." Wall Street Jour. Feb. 17, 2006; n. pag. Web. Jun. 2012. <http://online.wsj.com/article/sb114016916814767 17.htm>.

* cited by examiner

*Primary Examiner* — John Walters
*Assistant Examiner* — James Triggs
(74) *Attorney, Agent, or Firm* — Chapin IP Law, LLC

(57) ABSTRACT

A skate boot appliance for absorbing impact force of landing skating maneuvers by disposing a plunger or displacement member in a receptacle in response to an impact force, such that the receptacle is attached to a skate boot bottom and has a counterforce mechanism for resisting displacement below a threshold force, and resiliently deforming in response an impact force greater than the threshold force. The impact force is transferred from a skate blade through the plunger in response to a figure skating maneuver The disclosed plunger has a post and a horizontal displacement portion adapted to be disposed through the receptacle and engage the counterforce mechanism, such as the resilient planer member, in response to the threshold impact force, in which the horizontal displacement portion includes a convex ridge or protrusion for engaging the resilient planar member along an annular surface defined by the convex ridge.

24 Claims, 7 Drawing Sheets

SKATE BOOT FORCE ABSORBING APPLIANCE

RELATED APPLICATIONS

This patent application claims the benefit under 35 U.S.C. §119(e) of U.S. Provisional Patent App. No. 61/807,066, filed Apr. 1, 2013, entitled "SKATE BOOT FORCE ABSORBING APPLIANCE," incorporated by reference in entirety.

BACKGROUND

The incidence of injury in figure skating is common, especially among elite skaters who practice frequently and attempt to refine skills for performing difficult maneuvers. Some injuries occur due to errors, while others are caused by overuse of a joint, tendon, or bone. In a recent study of competition level figure skaters reported overuse injuries were common. These injuries included jumper's knee (patellar tendonitis), stress fractures, and ankle sprains. The previously listed overuse injuries mostly stem from the exertion of large mechanical loads on various portions of the leg while landing jumps. Such overuse injuries, including patellar tendonitis, stress fractures, and others believed to be caused by repeatedly landing jumps, can interrupt skating activities and prevent a skater from training or competing.

SUMMARY

A skate boot appliance attaches to the bottom of a skate boot and interfaces between a skate blade and the boot bottom for selectively absorbing impact forces above a load threshold that may result in injury to the skater. The appliance maintains the skate blade in a fixed arrangement during normal skating activities, so as to not to interfere with normal skating activities. Upon a predetermined force greater than the threshold, typically three to ten times the body weight of the skater, the appliance permits displacement of a plunger disposed between the skate blade and the bottom of the skate boot to move axially upward in response to a spring loaded counterforce mechanism designed to selectively respond to excessive force such as that resulting from jumps. Upon the landing force exceeding this load threshold, the appliance permits displacement of the blade through a piston assembly for mitigating the impact. The plunger displaces a counterforce mechanism, such as a leaf spring, in a receptacle housing the, and can employ a friction limiter to prevent a spring response in case that it is not viewed favorably according to competition rules by unnaturally assisting a skating maneuver.

Configurations herein are based, in part, on the observation that figure skate construction typically attaches a rigid blade to the bottom of a skate boot by a post or plane constructed of the blade material or a similar, rigid material. Unfortunately, such conventional approaches suffer from the shortcoming that substantially all of the momentum change resulting from landing of aerial maneuvers is transferred to the foot and ankle of the skater in short-duration, high-force impulses. Due to the hardness of the unyielding ice surface, such forces can be substantial. Conventional methods add padding and cushioning in the boot, however this approach allows force transfer to the skate boot, rather than absorbing forces at the boot/blade interface. Accordingly, configurations herein substantially overcome the above described shortcomings by providing an interface appliance in the form of a skate blade assembly that operates as a rigid skate blade for impact landings up to a threshold force, and absorbs and dampens impact forces that exceed the threshold force for activating displacement. This threshold force is deemed to be below that at which potentially harmful forces are transferred to the skater.

The skate boot appliance attaches to the bottom of a skate boot to absorb loads associated with a figure skating landing from such aerial maneuvers. The system is capable of absorbing impacts which otherwise could have resulted in loads several times the body weight of the skater, and includes a small beam spring or leaf spring and a piston or plunger attached to the blade. The spring-plunger system is preloaded to prevent any unwanted vertical motion of the blade while experiencing normal loads during skating. Use of the appliance in conjunction with a skate blade operates to reduce the occurrence of overuse injuries by absorbing the load that is usually transferred from the skate blade to the foot and leg during jump landings. The appliance is adjustable for allowing for the skater to determine an ideal preload, or tension, based on the individual's weight and the difficulty of the routine. The appliance will incorporate a one-directional friction function to prevent the spring from aiding in the initiation of jumps.

In an example arrangement, the plunger further comprises an asymmetrical teardrop shape for varying a response along a length of the plunger. The plunger has a teardrop shaped protrusion and the leaf spring is a solid, flat spring that deflects in 3 point bending when landing forces are applied. The plunger may also include a protrusion for concentrating the impact forces on a predetermined portion of the leaf spring, typically in the center of the plunger for engaging a central portion of the leaf spring.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Configurations discussed below demonstrate an example configuration for illustrating the principles and techniques employed herein for a method and apparatus to mitigate potentially harmful forces resulting from impact experienced by a skater and transferred through the skate blade.

A standard figure skate boot is composed of leather uppers with a wooden sole and a 1.5-2 inch heel to which the blade attaches. Within the conventional boot might be layers of padding to ensure a tight fit and help to cushion landings. Standard blades are generally made from either carbon steel or stainless steel and have varying rockers, or bends in the blade, depending on the type of skating the blade is intended to be used for. These blades mount directly to the bottom of the figure skate boot at the front and back of the boot.

The disclosed approach provides an absorption system for figure skates that will reduce injurious loads to help prevent both overuse injuries and injuries due to anomalies in skating maneuvers such as jump landing error. Configurations herein prevent movement of the device unless injurious loads are applied to mimic the feeling of stiffness provided by conventional blades. The appliance therefore aids in the prevention of jump landing-related injuries while abiding by the rules and regulations for competition by remaining rigid as a conventional blade unless triggered by excessive force. It therefore allows for the skater to skate normally, approach jumps, and exhibit various maneuvers skills with little risk of injury.

One objective of configurations disclosed herein, therefore, is to develop an appliance having a mechanical absorption system for a figure skate.

As previously discussed, the repeated application of substantial loads to a skater's joints can cause overuse injuries such as jumper's knee (patellar tendonitis), stress fractures, and ankle sprains. Conventional figure skates offer little shock absorption to help reduce these loads.

Figure 1:
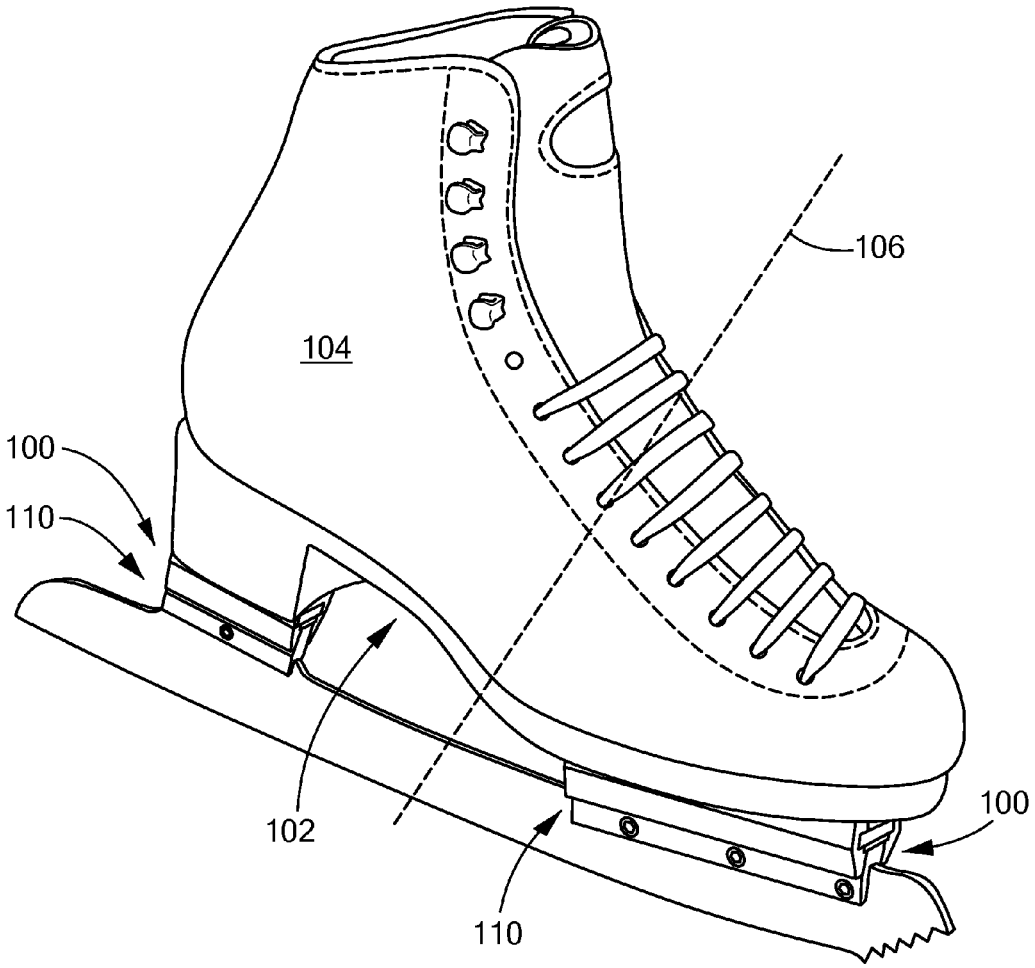
FIG. 1 shows a context view of the appliance in use on a skate boot.

FIG. 1 shows a context view of the appliance 100 in use on a skate boot 102. The skate footwear appliance 100 includes a base 110 adapted for attachment to the bottom 102 of a skate boot 104, and a receptacle in the base 110 adapted to receive a plunger, discussed further below. The plunger is responsive to external forces on the skate boot 104 from skating movements, such as an upward force resulting from landing following a jump. The receptacle has a counterforce mechanism for opposing the external forces from the jump, in which the counterforce mechanism defines a load threshold based on a computed external force injurious to a wearer of the skate boot 104. The plunger remains fixed in response to external forces below the threshold, permitting normal activities similar to a conventional fixed blade, and is responsive to external forces greater than the threshold by displacement within the receptacle. In an expected usage, the external forces are a substantially upward force in response to jumping movements of a skater, and the plunger is displaceable axially in response to the external force and substantially fixed with respect to lateral forces. In other words, the plunger moves only axially along the axis 106 orthogonal to the bottom 102 of the skate boot 104, substantially aligned with an upright position of the skater.

Figure 2:
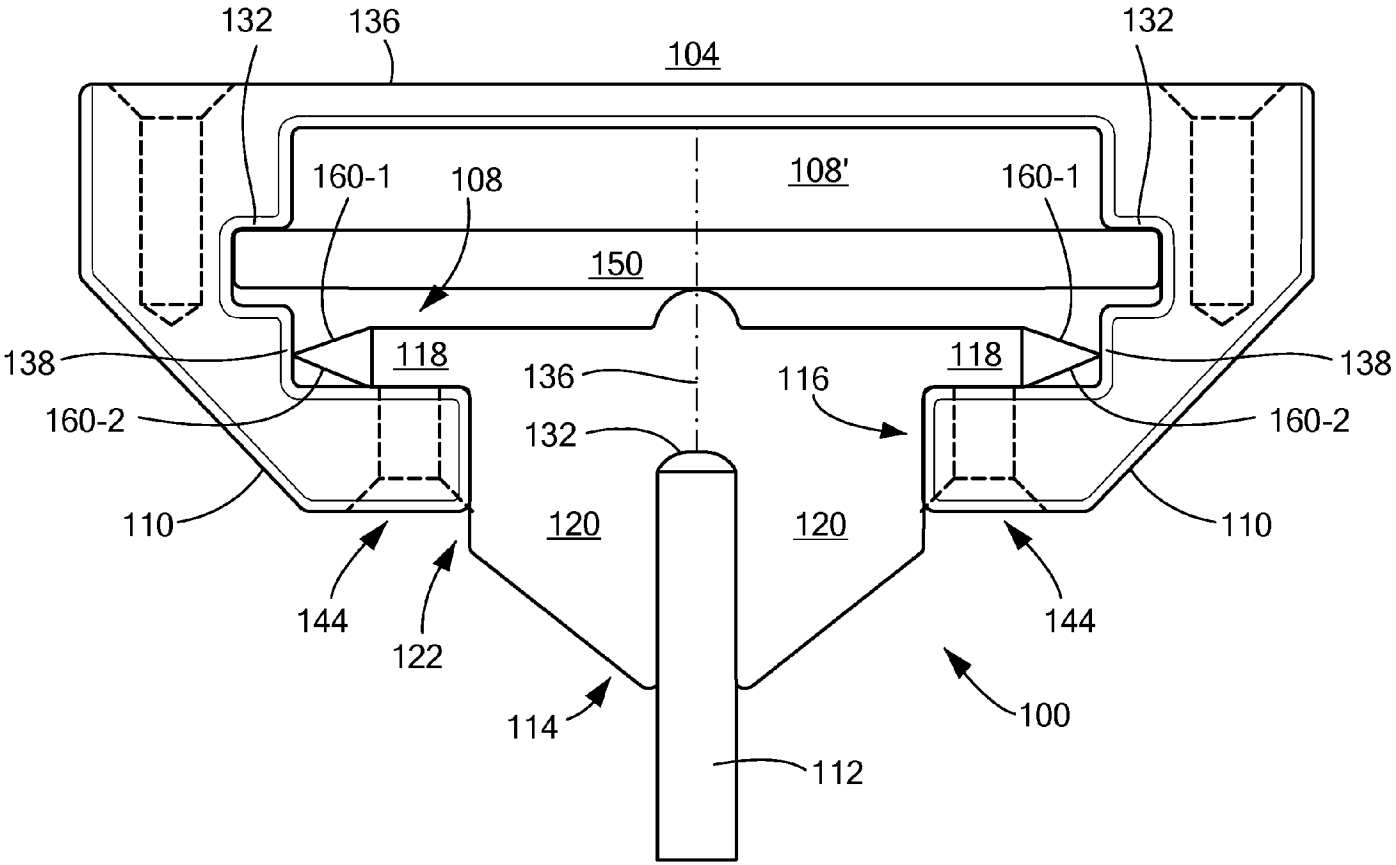
FIG. 2 shows a front elevation of a plunger and leaf spring disposed in the appliance in a particular configuration.

FIG. 2 shows a front elevation of a plunger and leaf spring disposed in the appliance in a particular configuration. Referring to FIGS. 1 and 2, the appliance 100 secures to a blade 112 attached to a distal end 114 of a displacement member 120 such as a plunger (nearest the ice), in which the blade 112 defines an interface between the skate boot 104 and the ice surface and is adapted to transmit the landing forces from the ice to the plunger responsive to movements of a wearer of the skate boot 104. The threshold force may be based on measurements or calculations of a skater wearing the boot landing on the blade 112 attached to the plunger following an airborne jump, such as height and weight of the skater, as well as an expected jump height and gravitational response that determine the landing force.

In the example arrangement, the displacement member 120 (plunger) further includes a shaft or post 122 extending downward from a bottom 102 of the boot 104 and attached to the blade 112 at a distal end 114, and a widened portion at a proximate end 116 for attachment to a horizontal displacement portion 118 generally forming a "T" shape, such that the receptacle 108 is adapted to receive the proximate end for accommodating vertical movement, and the distal portion of the shaft remains axially fixed in the receptacle for preventing lateral movement. The "T" shape is such that the wider portion occupies the proximate end 116 disposed in the receptacle 108 nearest the skate boot bottom 102 and perpendicular to the narrower orthogonal portion which provides parallel engagement to the blade.

At the proximate end of the receptacle nearest the boot, the counterforce mechanism comprises a resilient planar member 150, which in the example configuration is a leaf spring adapted to remain substantially fixed until the external force reaches the load threshold, and displaces further once the load threshold is reached. In the example arrangement, the spring is a flat, planar member such as a leaf spring that engages a convex arc and/or protrusion 130 on the plunger, and the base 110 further comprises a void on an opposed side of the leaf spring, such that the void is responsive to the leaf spring for receiving deflection. The leaf spring engages the plunger and shelves 132 or lips on opposed sides of the receptacle 108 in a 3 point manner for deflecting the external forces.

The appliance 100 therefore defines a skate blade assembly including a displacement member 120 or plunger having a horizontal displacement portion 118 coupled to a vertical post 122, such that the vertical post 122 has a blade interface 132 adapted to receive an elongated blade 112. A leaf spring, or resilient planar member 150 is adapted to receive force transferred from the blade interface 132 via the plunger, such that the resilient planar member 150 is deformable in response to the transferred force. A receptacle 108 houses the planar member 150 and is adapted to receive the plunger, such that the displacement portion 118 is adapted for slidable movement in the receptacle 108 and disposed against the planar member 150 for receiving the transferred force, in which the receptacle base 110 has a boot interface 136 on an opposed side for attachment to the skate boot 104.

The horizontal displacement portion 118 is substantially rectangular and adapted for placement within the base 110 on a skate boot 104, in which the post 120 extends perpendicularly from the horizontal displacement portion 118 and is elongated along a length of the rectangular shape and defines a center 136 of the displacement portion. As indicated above, the resilient planar member 150 may be a leaf spring or other suitable material adapted to deform in response to a predetermined threshold force. Alternatively, another suitable counterforce mechanism employing hydraulic, pneumatic or electromagnetic mechanisms may be employed. In particular configurations, the resilient planar member 150 may be formed of steel or other metal, a polymer fiber compound such as carbon fiber, or any suitable material having appropriate deflection and resiliency characteristics. The horizontal displacement portion 118 defining the plunger is adapted for bidirectional friction against the receptacle 108 for varying frictional force based on a direction of travel in the receptacle 108. The bidirectional nature allows lowered friction in an upward movement toward the skate boot 104 and into the receptacle, to allow timely response and force absorption upon impact. Conversely, the return to the rest (non-deformed) state occurs more slowly, due to increased friction between the displacement portion 118 and walls 138 of the receptacle in the downward direction, away from the skate boot.

A particular feature of the design addresses the notion that the appliance should not aid the skater in the initiation of any upward movement, such as jumping, to prevent appliance from giving the skater any unfair advantage during competition. To satisfy this constraint, the horizontal displacement portion 118 implements a one-directional friction component that disallows the plunger in the piston system to transfer loads back to the skater in the upward direction after downward load absorption. Conventional designs do not prevent this secondary load transfer, which may deviate from accepted standards for competition skates. Any absorption system used in competitive figure skating should only work in one direction. This means that it can absorb downward landing forces, but it cannot aid in the initiation of upward movement, i.e. jumping, of the figure skater. The shock absorption systems in the prior art do not account for this rule and may therefore be illegal in figure skating competitions.

Accordingly, the widened portion has friction limiters at a circumference of the widened portion, in which the friction limiters are for frictionally engaging the sides of the receptacle 108 in one direction and exhibit a different friction response in the opposed direction, and may also include hydraulic, pneumatic and electromagnetic systems or configurations. In the example configuration, the plunger further comprises beveled edges 160-1 . . . 160-2 (160 generally) for slidable communication with walls 138 of the receptacle 108, such that the beveled edges 160 provide frictional engagement with the receptacle 108. The beveled edges 160 are disposed in opposed directions for providing different frictional forces opposing the plunger motion. The beveled edges 160 further comprise a pair 160-1, 160-2 of angled surfaces, such that the angled surfaces 160-1, 160-2 engage the walls 138 (sides) of the receptacle in response to movement in respectively opposed directions. Beveled edge 160-1 frictionally engages the receptacle walls 138 in an upward direction, and toward the skate boot 104, during landing, while the beveled edge 160-2 engages the receptacle walls 138 in a downward direction, away from the skate boot 104. Increased friction on the beveled edge 160-2 results in slower downward, or return to rest position, movement, thus avoiding a sudden resilience, or "bouncing" sensation upon landing by the skater. The beveled edges 160 may take the form of triangular edge strips 162, or may be fabricated directly onto the horizontal displacement portion 118. In a particular arrangement, the receptacle walls 138 can have special directional properties so that the friction with the bevels 160 is greater on the return than on the landing. The idea is that this would not influence the ability to adsorb the landing load, but act to reduce the rebound. The bevel 160, or wipers, could also have different frictional properties on each surface—and could extend far enough so that they would engage the receptacle walls 138 with only one side.

The receptacle walls 138 may also be fabricated or treated for bidirectional frictional response. A "fish scale" patterning similar to cross-country skis, for example, may formed or etched into the walls for providing a graduated texture in the upward direction and a ribbed or stepped texture in the opposed (downward) direction. Alternatively, finer graduations, such as that formed from a diamond turning machine, may provide for more finely tuned frictional response.

Figure 3:
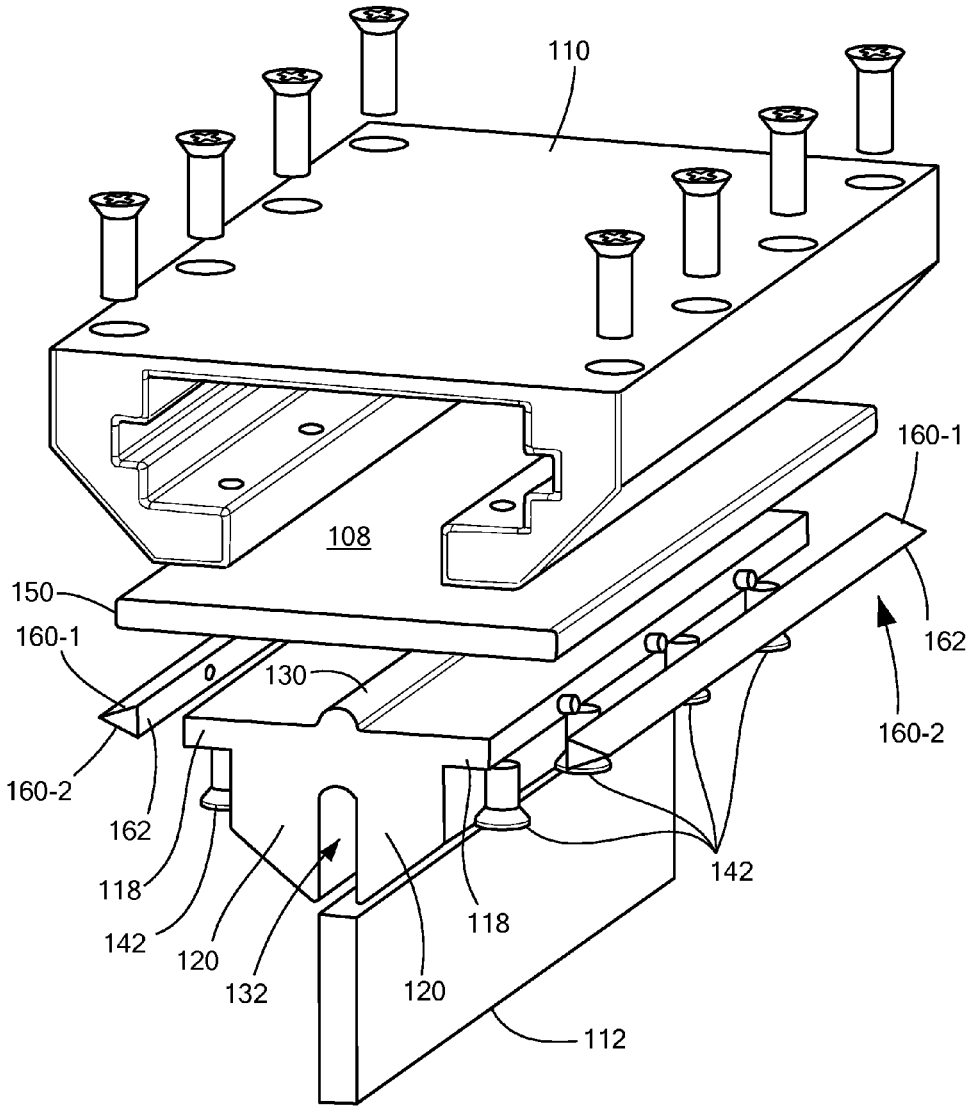
FIG. 3 shows an exploded view of the appliance of FIG. 2.

FIG. 3 shows an exploded view of the appliance of FIG. 2. Referring to FIGS. 2 and 3, the appliance 100 may provide a preloading bias, shown as preload screws 142, receivable into preload holes 144, such that the preloading bias imposes a preloading force on the planar member 150 for modifying the threshold force. The preloading bias is therefore defined by a set of screws 142 for forcing the planar member 150 in the direction of the transferred force from the plunger (displacement member 120). The screws 142 induce a preload, which is a predetermined force, based on the skater's weight that is exerted on the leaf spring to prevent the system from engaging during normal skating. The depth of the screws 142 advances the rest position of the displacement member 120 in the receptacle 108, to increase the threshold at which the displacement member 120 will begin operation (displacement) to accommodate landing force.

During landings, the blade interfaces with a plunger to push up on the leaf spring. This spring works to absorb the landing energy before it reaches the skater's foot. Two of the appliances 100 replace the conventional mounting plates that are incorporated into traditional figure skate blades, at the heel and toe ends of the skate boot, respectively. Although the landing force from a skater may tend to be focused on the toe portion of the skate 104, a complementary pair is employed because a single appliance would tend to unduly stress a rigid blade if it were mounted in a fixed position at the other end of the skate.

Figure 4:
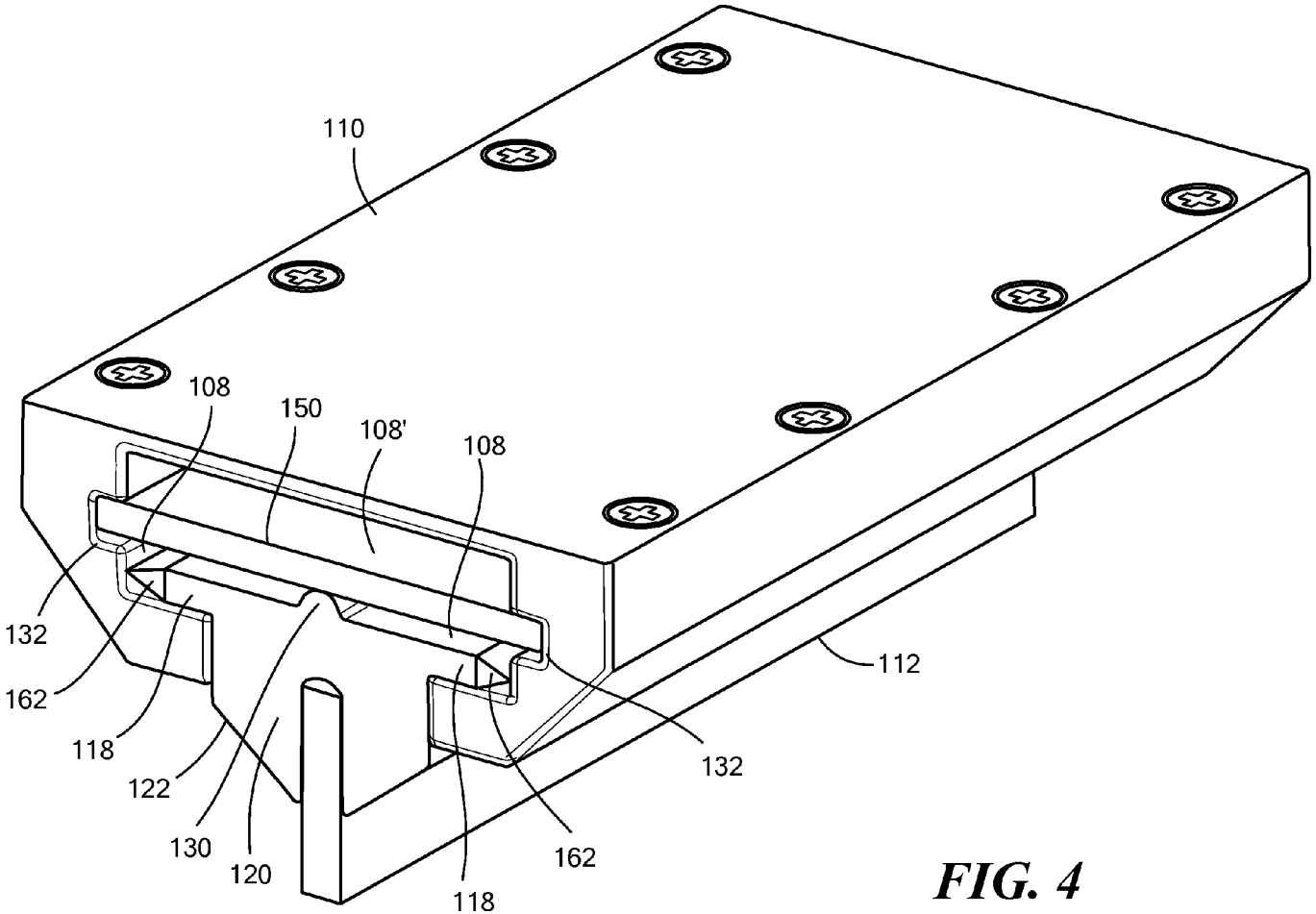
FIG. 4 shows a perspective view of the assembled appliance of FIG. 3.

FIG. 4 shows a perspective view of the assembled appliance of FIGS. 2 and 3. Referring to FIGS. 2-4, the resilient planar member 150 is compressibly disposed between the protrusion 130 of the displacement member 120 and the shelves 132, while a void 108' of the cavity 108 above the planer member 150 allows upward movement in response to absorbed force. Further, the shelves 132 allow a tolerance for the preloading screws 142 to adjust the rest position of the protrusion 130 and planar member 150 by forcing the displacement portion 118 upward. It should be noted that the preload will determine the "at rest" state of the resilient planar member 150, and may represent a constant force or displacement of the planar member 150 prior to any absorption of injurious loads.

Figure 5:
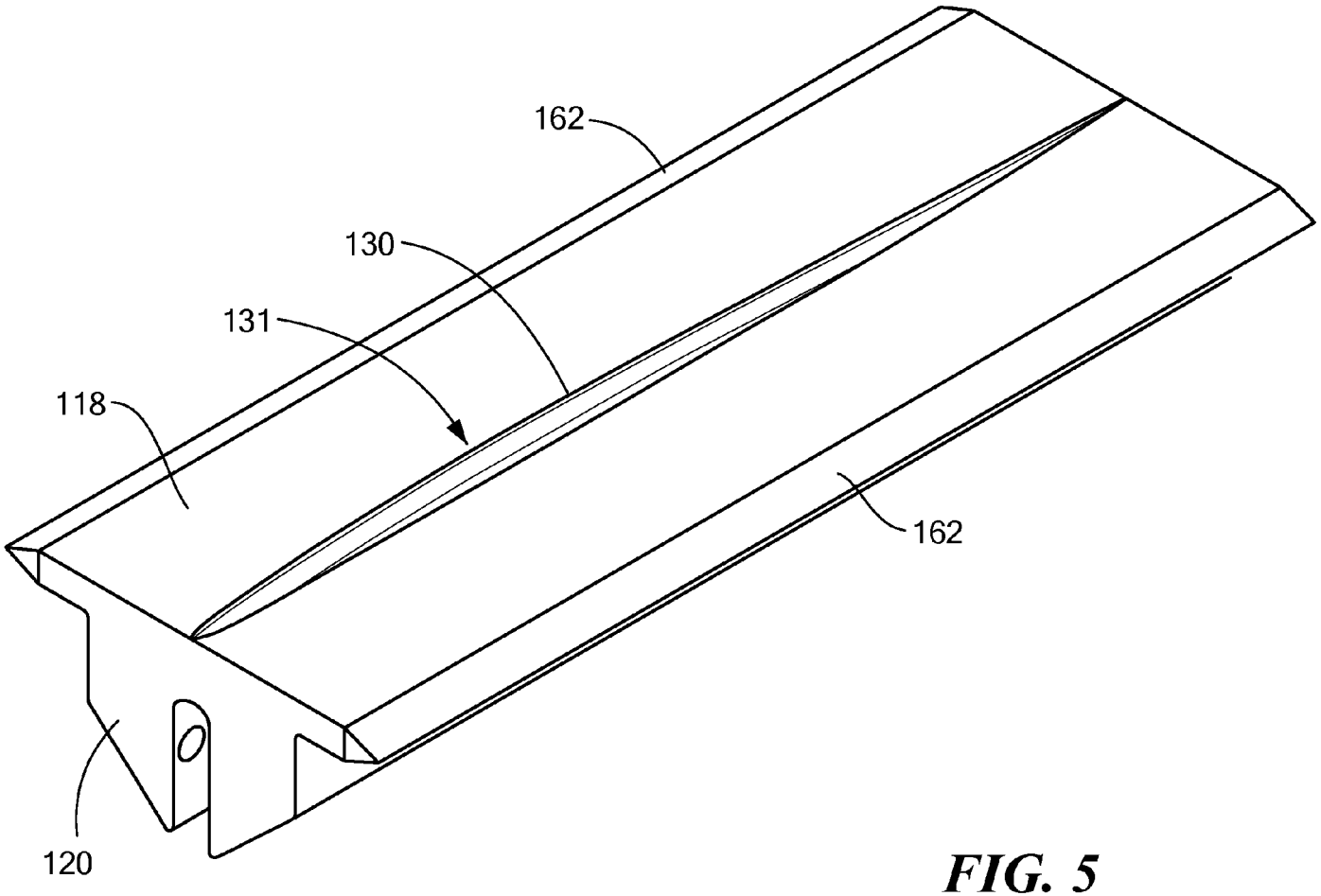
FIG. 5 shows a perspective view of the plunger of FIG. 4.

FIG. 5 shows a perspective view of the displacement member 120 of FIG. 4. Referring to FIG. 5, the protrusion 130 has an asymmetric annular shape, or "tear drop" form, for initiating a displacement force at an apex 131, or high point, of the protrusion 130. Alternate configurations may vary this arrangement to suit the application of force to the resilient planar member 150. Therefore, the horizontal displacement portion 118 includes a convex ridge defined by the protrusion 130 for engaging the resilient planar member 150 along an annular surface and apex 131 defined by the convex ridge.

Figure 6:
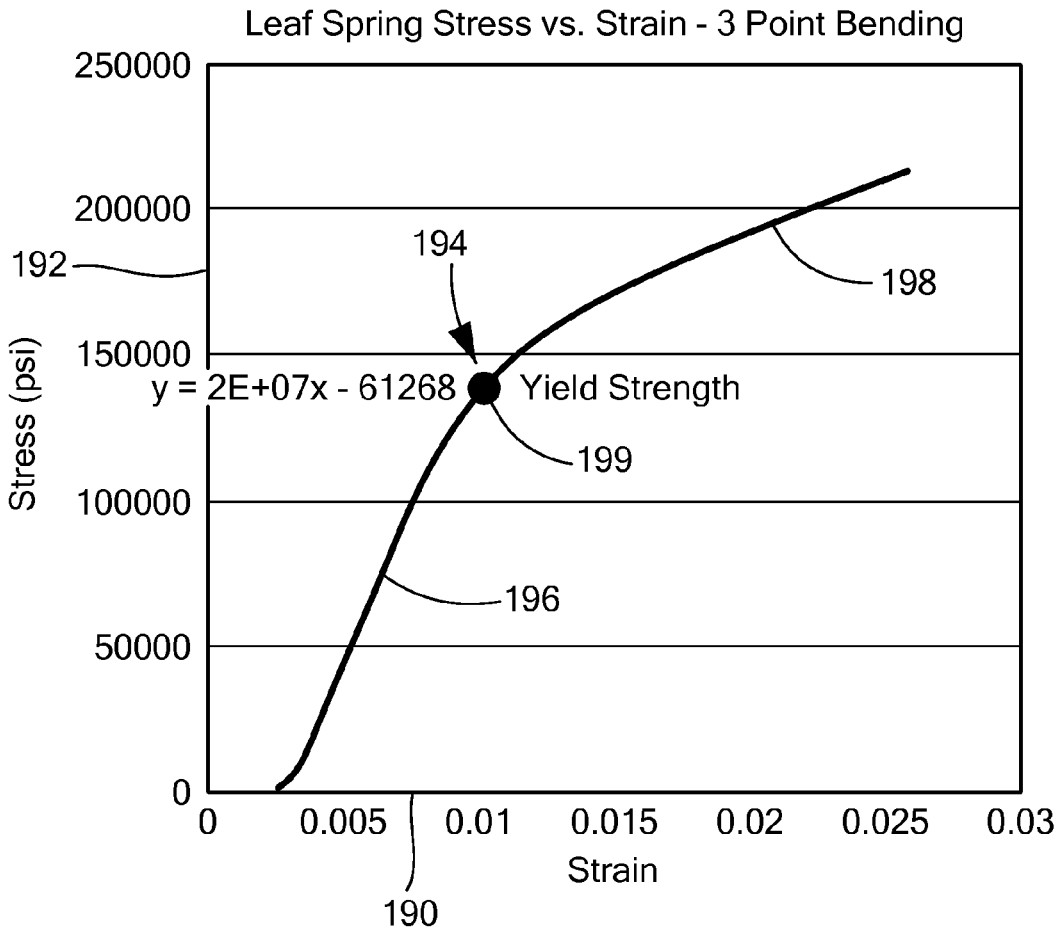
FIG. 6 shows a graph of forces absorbed by the appliance.

FIG. 6 shows a graph of forces absorbed by the appliance. Referring to FIGS. 1, 2 and 6, line 194 represents a stress vs. strain curve for a leaf spring prototype of the resilient planar member 150 in three-point bending test. A vertical axis 192 represents the landing force transferred upward through the displacement member 120 upon landing, and the horizontal axis 190 represents the strain response by the planar member 150. A yield strength 199 corresponds to the threshold force at which point the planer member 150 begins to deform in response to the force, and therefore relieve the impact that would otherwise be transferred to the skate boot 104. Force is transferred to the planer member 150 (upward) by the protrusion 130, which transfers force to a particular point due to the annular contour. Alternatively, a linear protrusion could be employed if more suited to the demands of the skater or the application. Further, the actual values of the prototype may be varied in alternate configurations to suit the design demands of a particular skater, particularly with respect to the injury threshold represented by the yield strength 199, as discussed above.

The proposed approach further provides a method of absorbing impact force by disposing a plunger or displacement member 120 in a receptacle 108 in response to an impact force, such that the receptacle has a counterforce mechanism for resisting displacement below a threshold force, and resiliently deforming in response an impact force greater than the threshold force. Such an impact force is transferred from a skate blade 112 through the plunger in response to a figure skating maneuver The disclosed plunger has a post 122 and a horizontal displacement portion 118 adapted to be disposed through the receptacle 108 and engage the counterforce mechanism, such as the resilient planer member 150, in response to the impact force, in which the horizontal displacement portion 118 includes a convex ridge or protrusion 130 for engaging the resilient planar member 150 along an annular surface defined by the convex ridge. Upon a potentially injurious skating landing, the mechanism imposes an opposing force by the counterforce mechanism by resiliently deforming, and returns to an undeformed state at a different rate than deformation resulting from directionally based friction response of the horizontal displacement member against walls of the receptacle. This avoids a "bounce" effect that lifts the skate from stored energy in the leaf spring, which may be deemed unfavorable in certain competition contexts.

Figure 7:
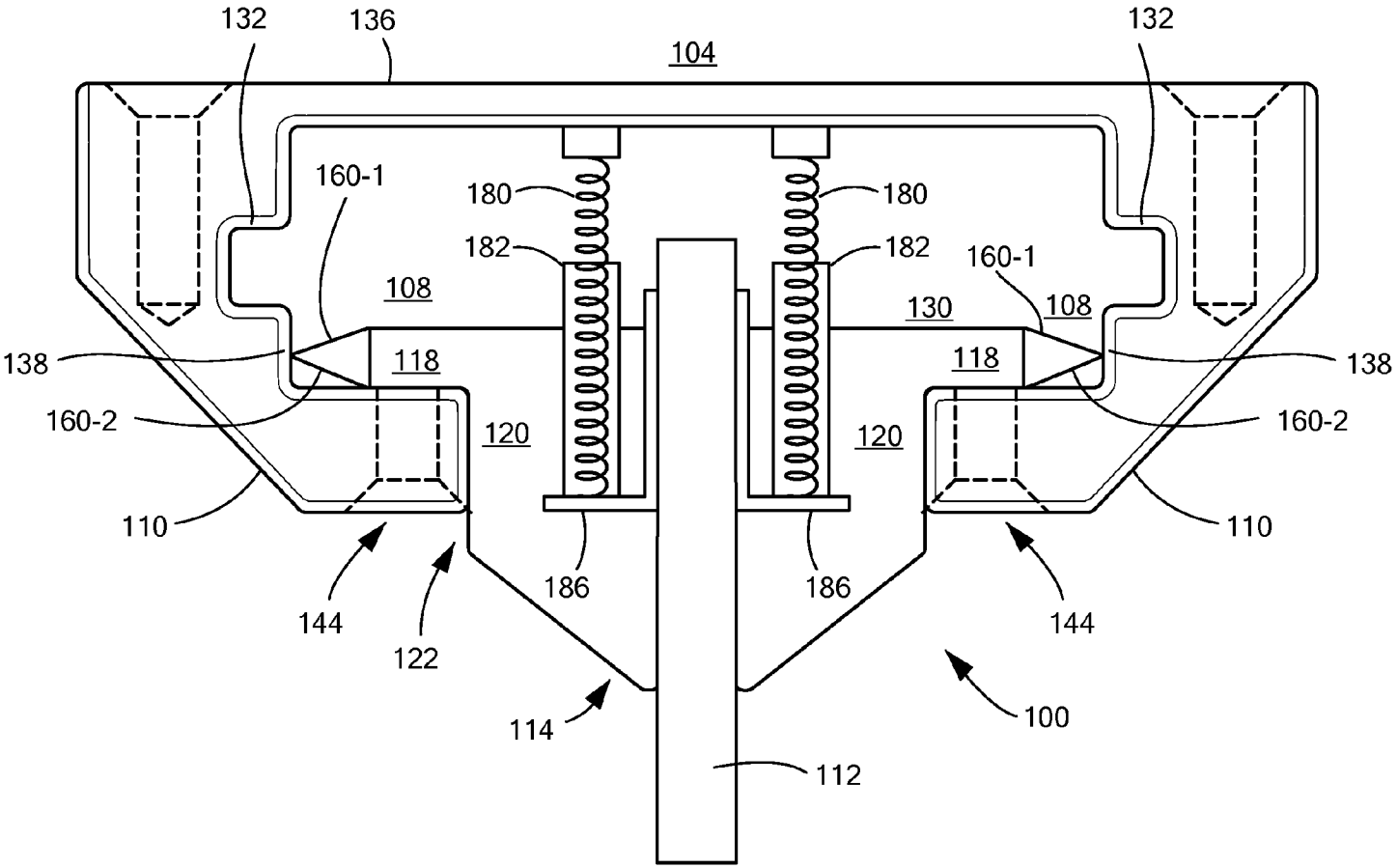
FIG. 7 shows an alternate configuration of the counterforce mechanism.

FIG. 7 shows an alternate configuration of the counterforce mechanism. Referring to FIGS. 2 and 7, the counterforce mechanism provided by the resilient planer member 150, such as a leaf spring, may also be provided by a coiled spring 180 or similarly positioned hydraulic or pneumatic (fluidic) coupling. The counterforce mechanism is directed by a directional component 182 for directing the counterforce toward the boot interface 104. The counterforce mechanism therefore provides a fluidic response to plunger movement for absorbing force via a hydraulic or pneumatic delivered pressure. The linkage of the fluidic or coiled spring is provided by communication with the blade 112 via a transverse coupling 186 or other suitable attachment to the blade. The transverse coupling therefore provides movement for travel of the blade 112 in the receptacle 108 region under the skate boot 104.

In contrast to conventional approaches, the disclosed approach attempts to completely dissipate injurious downward landing forces prior to such forces reaching the boot and being absorbed "through" the skater's foot, as with conventional padding and other mechanisms. The conventional approaches for figure skate boots popular with high-level skaters offer minimal shock absorption in the form of a cork heel on the skate as opposed to a wooden heel. There are no mechanical design components that are included to actively absorb landing loads. Conventional approaches seek to mitigate forces after they have been transferred to the skate boot, and not at the boot/blade interface.

In an attempt to remedy the previously listed shortcomings of the traditional figure skate boot, attempts have been made to absorb mechanical loads due to jump landings and that allow for flexing of the ankle, such as those disclosed in U.S. Pat. No. 7,531,068 (Fauver, 2009). A disclosed boot includes triangle-shaped portions cut out of the upper part of the boot, allowing ankle flexion, and a series of pistons mounted along this cut-out to absorb the load as the ankle flexes. In contrast to the present application, the disclosed pistons impede the skater's ability to closely cross their feet over or bring their feet close together during spins.

Researchers at the University of Delaware recently developed a hinged boot which enabled skaters to flex their ankles while skating and jumping allowing for more cushioned landings. While improving the cushioning of landings and allowing ankle flexion may alleviate some of the common skating injuries, since modifications are made directly to the boot, boot performance can be altered. In contrast, the proposed approach operates on the blade structure beneath the boot, leaving the constructions and skate boot "feel" unchanged from the perspective of a skater. Further, boot modifications typically require that the skater has to flex their ankles for force absorption. In contrast, the proposed approach works even if for some reason, maintaining equilibrium for example, the skater does not or cannot flex their ankle.

The most common absorption systems utilized in other athletic footwear such as sneakers are foams and air or liquid filled bladders within the midsole, such as those disclosed in U.S. Pat. No. 6,568,102 (Healy, 2003). Such foam methods however become much less effective with wear as the foams are compressed and the fluid bladders can be troublesome as fluids can leak from the bladders. Other athletic shoes use springs to aid in the absorption of forces, however a bidirectional spring may run afoul of competition constraints imposed on skates due to the mechanical advantage provided.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A skate footwear appliance comprising:

a base adapted for attachment to the bottom of a skate boot;

a receptacle in the base adapted to receive a plunger;

the plunger responsive to external forces on the skate boot from skating movements;

the receptacle having a counterforce mechanism for opposing the external forces, the counterforce mechanism having a load threshold based on an external force injurious to a wearer of the skate boot; and the plunger remaining fixed in response to external forces below the threshold, and responsive to external forces greater than the threshold by displacement within the receptacle.

2. The appliance of claim 1 wherein the external forces are substantially upward force in response to jumping movements of a skater, and the plunger is displaceable axially in response to the external force and substantially fixed with respect to lateral forces.

3. The appliance of claim 2 further comprising a blade attached to a distal end of the plunger, the blade defining an interface between the skate boot and an ice surface and adapted to transmit the external forces from the ice to the plunger responsive to movements of a wearer of the skate boot.

4. The appliance of claim 2 wherein the threshold force is based on measurements of a skater wearing the boot landing on a blade attached to the plunger following an airborne jump.

5. The appliance of claim 3 wherein the plunger further comprises:

a shaft extending downward from a bottom of the boot and attached to the blade at a distal end; and a widened portion at a proximate end, the receptacle adapted to receive the proximate end for accommodating vertical movement, the distal portion of the shaft remaining axially fixed in the receptacle for preventing lateral movement.

6. The appliance of claim 5 wherein the widened portion has friction limiters at a circumference of the widened portion, the friction limiters for frictionally engaging the sides of the receptacle in one direction and having a different friction response in the opposed direction.

7. The appliance of claim 1 wherein the counterforce mechanism comprises a spring adapted to remain substantially fixed until the external force reaches the load threshold, and displaces further in response to forces less than the load threshold once the load threshold is reached.

8. The appliance of claim 7 wherein:

the spring is a leaf spring for engaging the plunger in a 3 point manner responsive to the external forces; and the base further comprises a void on an opposed side of the leaf spring, the void responsive to the leaf spring for receiving deflection.

9. The appliance of claim 8 wherein the plunger further comprises an asymmetrical teardrop shape for varying a response along a length of the plunger.

10. The appliance of claim 8 wherein the plunger further comprises a protrusion having a half tear-drop shape for concentrating the external forces on a predetermined portion of the leaf spring.

11. The appliance of claim 9 wherein the plunger comprises a "T" shape having a broad portion at the proximate end disposed in the receptacle and a narrower orthogonal portion engaging the blade.

12. A skate blade assembly comprising:

a plunger having a horizontal displacement portion coupled to a vertical post, the vertical post having a blade interface adapted to receive an elongated blade;

a resilient planar member adapted to receive force transferred from the blade interface via the plunger, the resilient planar member being deformable in response to the transferred force;

a receptacle housing the planar member and adapted to receive the plunger, the displacement portion adapted for slidable movement in the receptacle and disposed against the planar member for receiving the transferred force, the receptacle having a boot interface on an opposed side for attachment to a skate boot.

13. The method of claim 12 wherein the horizontal displacement portion is substantially rectangular and adapted for placement on a skate boot, the post extending perpendicularly from the horizontal displacement portion and elongated along a length of the rectangular shape and defining a center of the displacement portion.

14. The method of claim 13 wherein the horizontal displacement portion further comprises a convex ridge for engaging the resilient planar member along an annular surface defined by the convex ridge.

15. The method of claim 12 wherein the resilient planar member is a leaf spring adapted to deform in response to a predetermined threshold force.

16. The method of claim 12 wherein the plunger is adapted for bidirectional friction against the receptacle for varying frictional force based on a direction of travel in the receptacle.

17. The method of claim 16 wherein the plunger further comprises beveled edges for slidable communication with walls of the receptacle, the beveled edges providing frictional engagement with the receptacle, the beveled edges disposed in opposed directions for providing different frictional forces opposing the plunger motion.

18. The method of claim 17 wherein the beveled edges further comprise a pair of angled surfaces, the angled surfaces engaging the sides of the receptacle in response to movement in respectively opposed directions.

19. The method of claim 15 Further comprising a preloading bias, the preloading bias imposing a preloading force on the planar member for modifying the threshold force.

20. The method of claim 19 wherein the preloading bias further comprises a set of screws for forcing the planar member in the direction of the transferred force from the plunger.

21. The method of claim 16 wherein the bidirectional friction is provided by a bidirectional pattern formed in a receptacle wall in slidable communication with the plunger.

22. The method of claim 1 wherein the counterforce mechanism further comprises a fluidic response to plunger movement for absorbing force via a hydraulic or pneumatic delivered pressure.

23. The method of claim 1 wherein the counterforce mechanism further comprises a coiled spring in communication with the blade via a transverse coupling.

24. A method of absorbing impact force, comprising disposing a plunger in a receptacle in response to an impact force, the receptacle having a counterforce mechanism for resisting displacement below a threshold force, and resiliently deforming in response an impact force greater than the threshold force, the impact force transferred from a skate blade through the plunger in response to a figure skating maneuver;

the plunger having a post and a horizontal displacement portion adapted to be disposed through the receptacle and engage the counterforce mechanism in response to the impact force, the horizontal displacement portion including a convex ridge for engaging the resilient planar member along an annular surface defined by the convex ridge;

imposing an opposing force by the counterforce mechanism by resiliently deforming, and returning to an undeformed state at a different rate than deformation resulting from directionally based friction response of the horizontal displacement member against walls of the receptacle.

* * * * *